US008882129B2

(12) United States Patent
Nault et al.

(10) Patent No.: US 8,882,129 B2
(45) Date of Patent: Nov. 11, 2014

(54) LEG SUPPORT ASSEMBLY FOR USE WITH A WHEELCHAIR AND METHODS OF ASSEMBLING SAME

(71) Applicant: R We Having Fun Yet, LLC, Las Vegas, NV (US)

(72) Inventors: Wendolyn R. Nault, Las Vegas, NV (US); Philip M. Nault, Las Vegas, NV (US); Betty Dale Robins, Las Vegas, NV (US)

(73) Assignee: R We Having Fun Yet, LLC, Las Vegas, NV (US)

( * ) Notice: Subject to any disclaimer, the term of this patent is extended or adjusted under 35 U.S.C. 154(b) by 25 days.

(21) Appl. No.: 13/722,405

(22) Filed: Dec. 20, 2012

(65) Prior Publication Data

US 2013/0161922 A1 Jun. 27, 2013

Related U.S. Application Data

(60) Provisional application No. 61/580,545, filed on Dec. 27, 2011.

(51) Int. Cl.
*A61G 5/12* (2006.01)
*A61G 5/02* (2006.01)

(52) U.S. Cl.
CPC ..... *A61G 5/12* (2013.01); *A61G 2005/127* (2013.01); *A61G 5/02* (2013.01); *A61G 2005/128* (2013.01)
USPC ..... 280/304.1; 297/423.4

(58) Field of Classification Search
USPC ..... 280/250.1, 304.1; 297/423.39, 423.4
See application file for complete search history.

(56) References Cited

U.S. PATENT DOCUMENTS

| | | | | | |
|---|---|---|---|---|---|
| 909,411 | A * | 1/1909 | Hockney | 297/45 |
| 3,109,394 | A * | 11/1963 | Golden | 112/10 |
| 4,192,546 | A * | 3/1980 | Smith | 297/466 |
| 4,565,385 | A * | 1/1986 | Morford | 280/304.1 |
| 5,127,113 | A * | 7/1992 | Di Matteo et al. | 5/81.1 C |
| 5,211,414 | A * | 5/1993 | Galumbeck | 280/250.1 |
| 5,286,046 | A * | 2/1994 | Bottemiller et al. | 280/47.38 |
| 5,333,887 | A * | 8/1994 | Luther | 280/250.1 |
| 5,382,036 | A * | 1/1995 | Counts et al. | 280/250.1 |
| 5,522,644 | A | 6/1996 | Peek | |
| 5,833,318 | A * | 11/1998 | Knight | 297/423.4 |
| 5,906,415 | A | 5/1999 | Mocur | |
| 6,168,238 | B1 * | 1/2001 | Hannagan | 297/423.3 |
| 6,669,287 | B1 * | 12/2003 | DeLilla | 297/243 |

(Continued)

*Primary Examiner* — Kevin Hurley
(74) *Attorney, Agent, or Firm* — Howard & Howard Attorneys PLLC

(57) ABSTRACT

A leg support assembly for use with a wheelchair is described herein. The wheelchair includes a frame, a seat assembly coupled to the frame, and a pair of legs extending outwardly from the frame. The pair of legs includes a first leg and a second leg spaced a distance from the first leg such that a gap is defined therebetween. The leg support assembly includes a support member that includes a first end that is removably coupled to the first leg and a second end that is removably coupled to the second leg. The support member also includes a flexible substrate material that extends across the leg gap to prevent a patient seated in the wheelchair from entering the gap. The leg support assembly also includes a fastening assembly that is coupled to the support member to facilitate coupling the support member to the wheelchair.

20 Claims, 7 Drawing Sheets

(56) References Cited

U.S. PATENT DOCUMENTS

| | | | | |
|---|---|---|---|---|
| 6,981,714 | B1 | 1/2006 | Schell et al. | |
| 7,036,838 | B2 | 5/2006 | Leffler | |
| 7,597,339 | B2 * | 10/2009 | Furusho | 280/304.1 |
| 7,780,239 | B1 | 8/2010 | Kwiatkowski | |
| 8,544,866 | B2 * | 10/2013 | Noonan et al. | 280/304.1 |
| 2002/0135159 | A1 | 9/2002 | Watkins | |
| 2008/0272573 | A1 * | 11/2008 | Hiatt | 280/304.1 |
| 2012/0292883 | A1 | 11/2012 | Noonan et al. | |

* cited by examiner

LEG SUPPORT ASSEMBLY FOR USE WITH A WHEELCHAIR AND METHODS OF ASSEMBLING SAME

CROSS-REFERENCE TO RELATED APPLICATIONS

This application claims the benefit of U.S. Provisional Application No. 61/580,545, filed Dec. 27, 2011, the disclosure of which is incorporated herein by reference.

BACKGROUND OF THE INVENTION

The subject matter described herein relates generally to wheelchairs and, more particularly, to a leg support assembly for use with a wheelchair and methods of assembling a wheelchair.

At least some known wheelchairs include a plurality of wheels, a support frame coupled to the wheels, a seat coupled to the support frame, and a pair of legs that extend outwardly from the support frame. Each leg includes a footrest that is coupled to the leg to support a patient's leg. In known wheelchairs, adjacent legs are spaced a distance apart such that a gap is defined therebetween.

During use of known wheelchairs, as a patient is seated on the seat assembly, the patient's legs extend outwardly from the seat assembly towards the footrests. However, some patients may not have sufficient leg strength or dexterity to keep their legs on the footrest. Moreover, over time a patient may tire, and/or suffer from periodic leg spasms. As such, the patient's legs may slip from the footrests and fall into the gap defined between the legs. As the patient's legs fall between the legs, the legs may contact the support frame, the ground, and/or the wheelchair wheels causing injury to the patient.

BRIEF DESCRIPTION OF THE INVENTION

In one aspect, a leg support assembly for use with a wheelchair is provided. The wheelchair includes a frame, a seat assembly coupled to the frame, and a pair of legs extending outwardly from the frame. The pair of legs includes a first leg and a second leg spaced a distance from the first leg such that a gap is defined therebetween. The leg support assembly includes a support member that includes a first end that is removably coupled to the first leg and a second end that is removably coupled to the second leg. The support member also includes a flexible substrate material that extends across the leg gap to prevent a patient seated in the wheelchair from entering the gap. The leg support assembly also includes a fastening assembly that is coupled to the support member to facilitate coupling the support member to the wheelchair.

In another aspect, a wheelchair assembly is provided. The wheelchair assembly includes a support frame, a seat assembly coupled to the support frame, a pair of legs coupled to the support frame and extending outwardly from the seat assembly, and a leg support assembly coupled to the pair of legs. The pair of legs includes a first leg and a second leg spaced a distance from the first leg such that a gap is defined therebetween. The leg support assembly includes a support member having a first end that is removably coupled to the first leg and a second end that is removably coupled to the second leg. The support member also includes a flexible substrate material that extends across the leg gap to prevent a patient seated in the wheelchair from entering the gap. The leg support assembly also includes a fastening assembly that is coupled to the support member to facilitate coupling the support member to the pair of support legs.

In yet another aspect, a method of assembling a leg support assembly for use with a wheelchair is provided. The method includes providing a flexible substrate material and forming a first sidewall and a second sidewall from the flexible substrate material. The first sidewall and the second sidewall each have an inner surface, an outer surface, a first end, and an opposite second end. The inner surface and the outer surface extend between the first end and the second end. A fold line is defined between the first sidewall and the second sidewall. The method includes coupling a plurality of fastening members to the first sidewall inner surface, folding the first sidewall towards the second sidewall along the fold line, and coupling the second sidewall to the first sidewall such the first sidewall inner surface is adjacent to the second sidewall inner surface.

DETAILED DESCRIPTION OF THE INVENTION

The exemplary systems and methods described herein overcome at least some disadvantages of known wheelchairs by providing a leg support assembly that extends across adjacent wheelchair legs to prevent a patient's legs from undesirably entering a gap defined between the adjacent legs. Moreover, the leg support assembly described herein includes a flexible support member that is coupled to each leg, and that extends between adjacent legs to prevent a patient's legs from falling into a gap that would otherwise exist between the legs. As such, the flexible leg support assembly provides additional comfort and support to the patient's legs and facilitates preventing injury to the patient.

Figure 1:
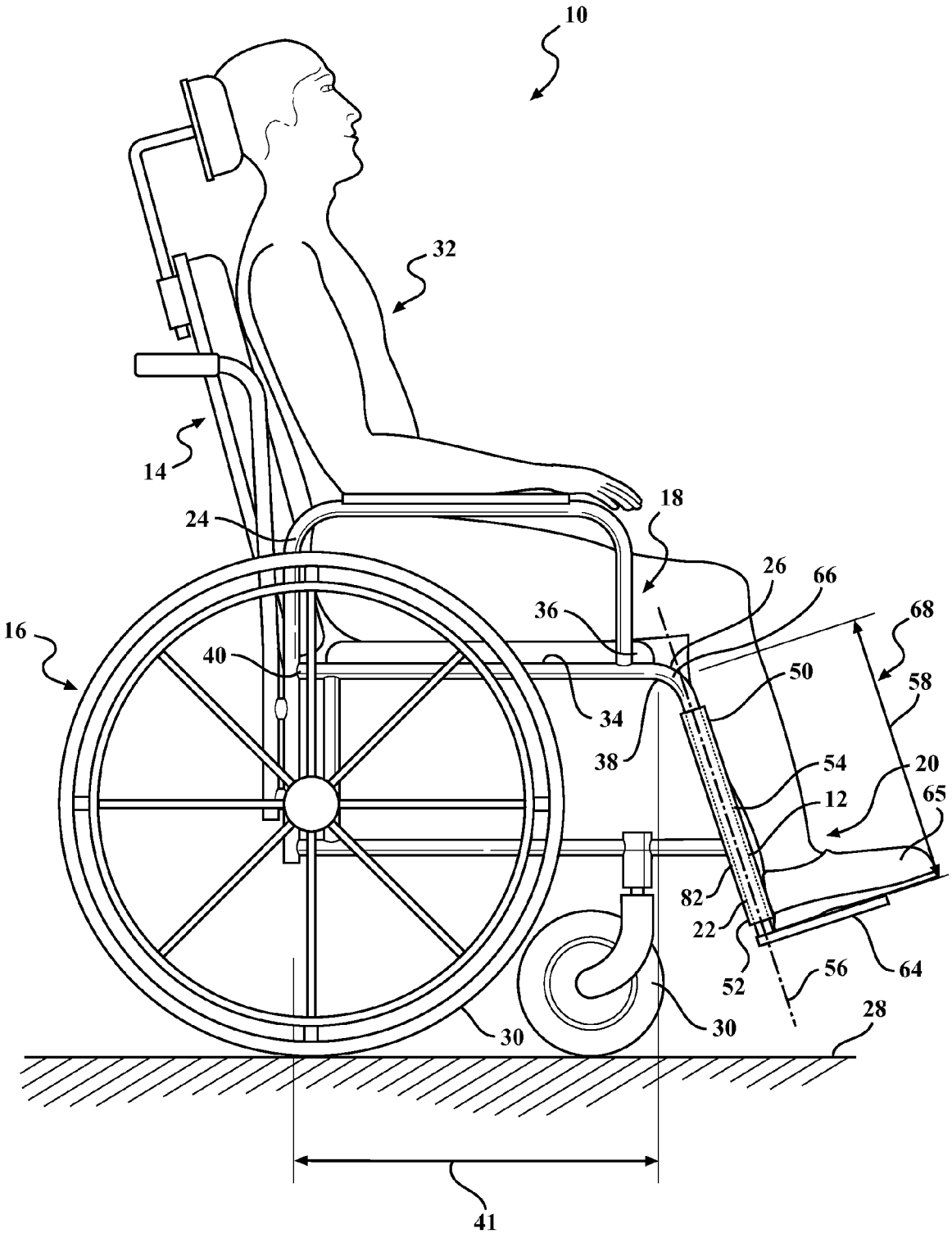
FIG. 1 is a schematic side view of an exemplary wheelchair assembly.
Figure 2:
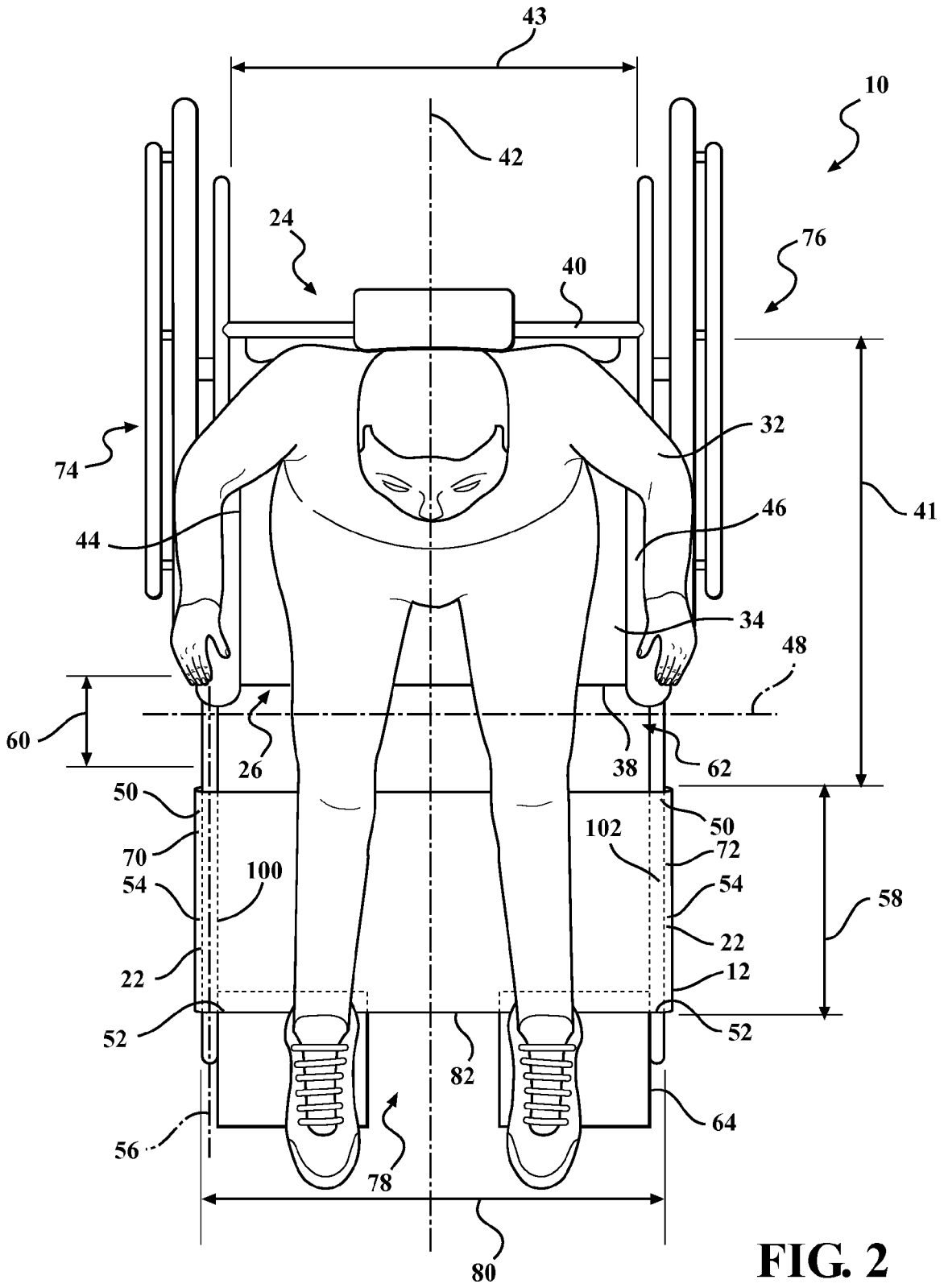
FIG. 2 is a schematic top view of the wheelchair assembly shown in FIG. 1.
Figure 3:
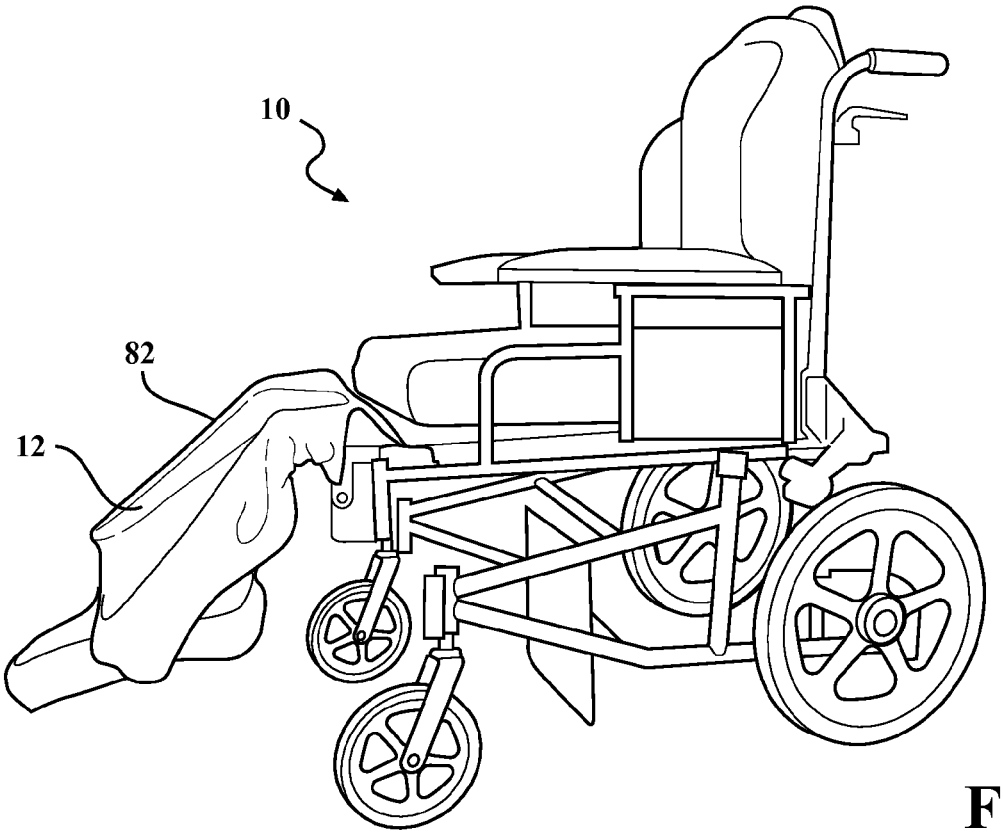
FIGS. 3 and 4 are perspective views of the wheelchair assembly shown in FIG. 1.
Figure 4:
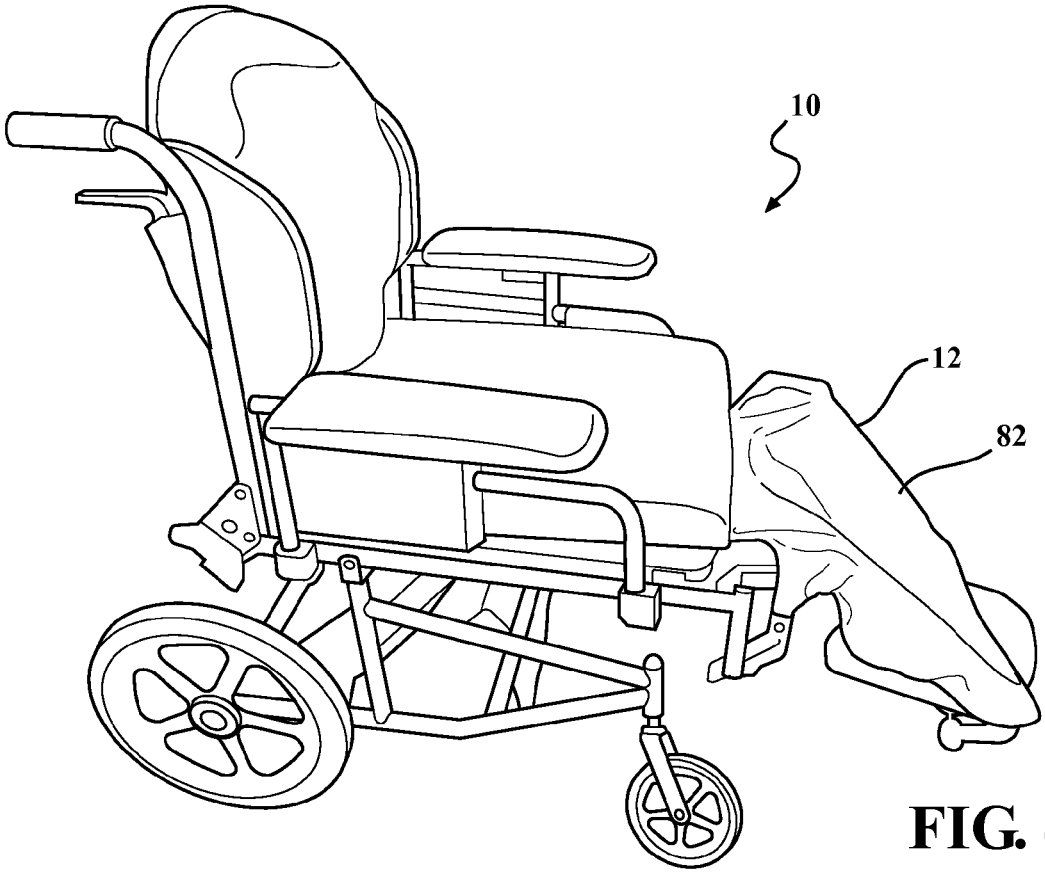
Figure 5:
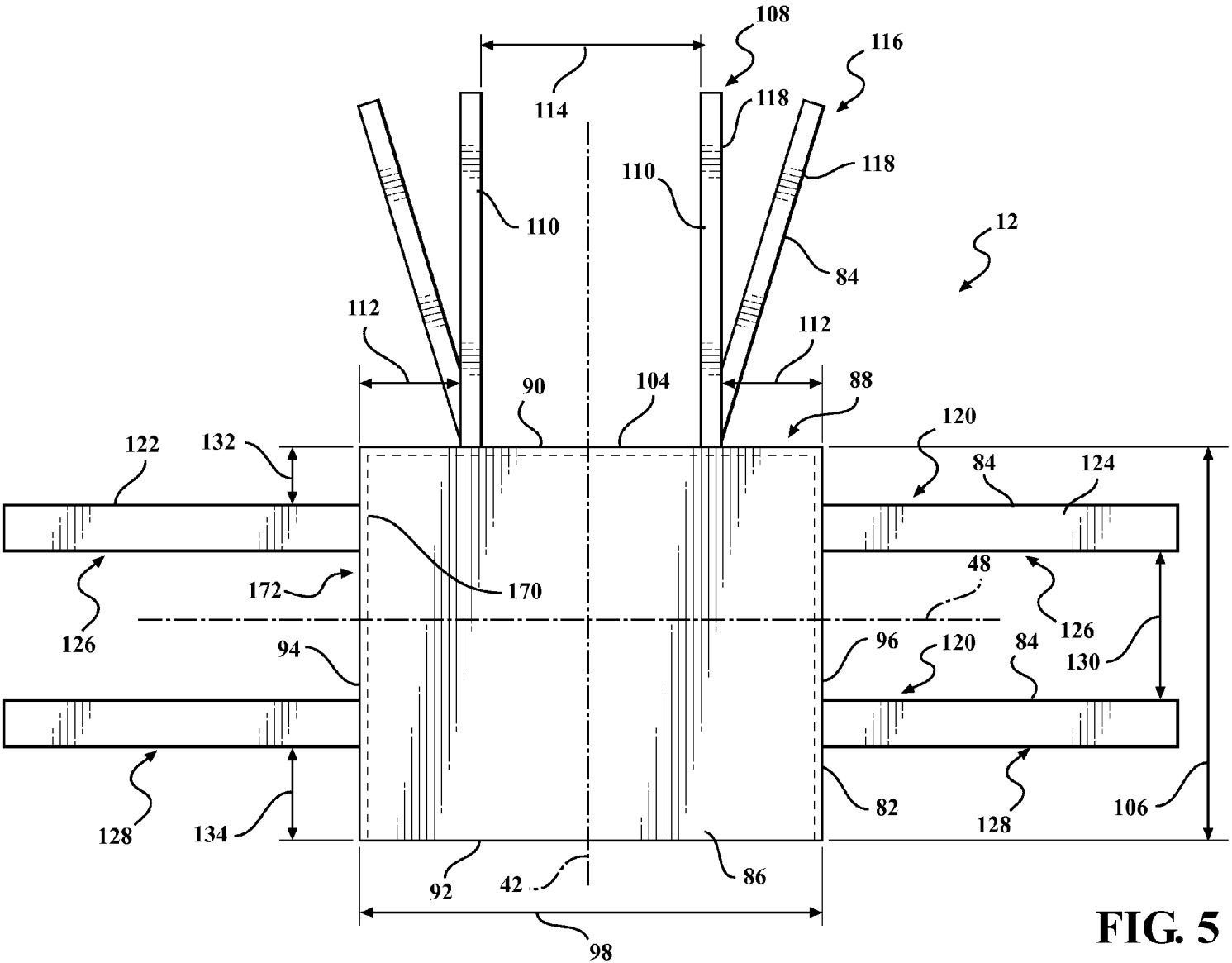
FIG. 5 is a schematic front view of an exemplary leg support assembly that may be used with the wheelchair assembly shown in FIGS. 1-4.

FIG. 1 is a schematic side view of an exemplary wheelchair assembly 10. FIG. 2 is a schematic top view of wheelchair assembly 10. FIGS. 3 and 4 are perspective views of wheelchair assembly 10. FIG. 5 is a schematic front view of an exemplary leg support assembly 12 used with wheelchair assembly 10. In the illustrated embodiment, the wheelchair assembly 10 includes a support frame 14, a wheel assembly 16, a seat assembly 18, and a pair 20 of legs 22. The support frame 14 extends between a rear section 24 and a forward section 26. The wheel assembly 16 is coupled to the support frame 14 for supporting the support frame 14 a distance above a supporting surface 28. The wheel assembly 16 includes a plurality of wheels 30 that are each rotatably coupled to the support frame 14 to enable a patient 32 to move the wheelchair assembly 10 along the supporting surface 28. The seat assembly 18 is coupled to the support frame 14 for supporting a patient 32 from support frame 14 such that the patient 32 is supported a distance above supporting surface 28.

In the illustrated embodiment, the seat assembly 18 includes a plate 34 and a seat 36 supported from the plate 34. The plate 34 extends between a forward end 38 and a rear end 40 along a longitudinal axis 42, and between a first side 44 and a second side 46 along a transverse axis 48 that is substantially perpendicular to longitudinal axis 42. The plate 34 has a length 41 measured between the forward end 38 and the rear end 40 along the longitudinal axis 42, and a width 43 measured between the first side 44 and the second side 46 along the transverse axis 48. The rear end 40 is adjacent to the support frame rear section 24, and the forward end 38 is adjacent to the support frame forward section 26. Alternatively, the seat assembly 18 may include a flexible seat member (not shown) that extends across the support frame 14 to support the patient 32 from the support frame 14. In addition, the support frame 14 may be configured to collapse to reduce the overall size of the wheelchair assembly 10 to facilitate the wheelchair assembly 10 being stored.

In the illustrated embodiment, each leg 22 is coupled to the support frame 14 and extends outwardly from the support frame forward section 26 away from the seat assembly 18. Each leg 22 includes a first end 50, a second end 52, and an outer surface 54 that extends between the first end 50 and the second end 52 along a centerline axis 56. Each leg 22 has a length 58 measured between the first and second ends 50 and 52 along centerline axis 56. The first end 50 is coupled to the support frame forward section 26 and is positioned adjacent to the seat assembly forward end 38. Moreover, the first end 50 is spaced a distance 60 from the seat assembly forward end 38 such that a first gap 62 is defined between the seat assembly forward end 38 and the leg first end 50. Each leg 22 also includes a footrest 64 that is coupled to the second end 52. Each footrest 64 is configured to support a patient's foot 65 from the leg 22.

In the illustrated embodiment, each leg 22 is pivotably coupled to the support frame 14 such that each leg 22 is independently movable with respect to the support frame 14. More specifically, the leg first end 50 is pivotably coupled to the support frame forward section 26 at a pivot point 66. Each leg 22 is independently movable about the pivot point 66 between a first position, i.e. an extended position (not shown), and a second position, i.e. a flexed position 68, and a third position, i.e. a retracted position (not shown). In the extended position, the leg 22 is oriented substantially parallel to the seat assembly 18. In the flexed position 68, the leg 22 is oriented obliquely with respect to the seat assembly 18. In the retracted position, the leg 22 is orientated substantially vertically and is substantially perpendicular to the seat assembly 18. In addition, because each leg 22 is independently pivotable with respect to the support frame 14, a patient may selectively position adjacent legs 22 in different orientations.

In the illustrated embodiment, the wheelchair assembly 10 includes a first leg 70 and a second leg 72. The first leg 70 is coupled to a first side 74 of the support frame 14. The second leg 72 is coupled to a second side 76 of the support frame 14, and is spaced a distance from the first leg 70 along transverse axis 48 such that a second gap 78 is defined between the first leg 70 and the second leg 72. The second gap 78 has a width 80 measured between the first and second legs 70 and 72 along the transverse axis 48.

The leg support assembly 12 is removable coupled to each leg 22 to support at least a portion of the patient 32 from the support frame 14. More specifically, the leg support assembly 12 is coupled to the support frame 14 and to each leg 22 such that the leg support assembly 12 extends across the second gap 78 to facilitate preventing a patient's leg from entering into the second gap 78. In the illustrated embodiment, the leg support assembly 12 includes a support member 82 and a plurality of fastening assemblies 84 that are coupled to the support member 82. Each fastening assembly 84 extends outwardly from the support member 82 to couple the support member 82 to the support frame 14 and/or to each leg 22.

The support member 82 includes an inner surface 86 and an opposite outer surface 88. The inner surface 86 and the outer surface 88 each extend between an upper end 90 and a lower end 92 along the longitudinal axis 42, and between a first end 94 and a second end 96 along the transverse axis 48. The support member 82 has a width 98 measured between the first and second ends 94 and 96 along the transverse axis 48. The support member width 98 is wider than the second gap width 80 such that the support member 82 extends across the second gap 78 from the first leg 70 to the second leg 72.

In the illustrated embodiment, the support member first end 94 is coupled to the first leg 70 such that the support member inner surface 86 extends circumferentially about at least a portion of an outer surface 100 of the first leg 70. Moreover, the support member first end 94 is orientated with respect to the first leg 70 such that the support member outer surface 88 extends across the first leg 70 to prevent a patient's leg from contacting the first leg outer surface 100. Similarly, the support member second end 96 is coupled to the second leg 72 such that the support member inner surface 86 extends circumferentially about at least a portion of an outer surface 102 of the second leg 72. In addition, support member second end 96 is positioned with respect to the second leg 72 such that the support member outer surface 88 substantially covers the second leg 72 to prevent a patient's leg from contacting the second leg outer surface 102. In addition, the support member 82 is configured to be reversible such that a patient may position the support member 82 such that the outer surface 88 is adjacent the leg outer surfaces 100 and 102.

In the illustrated embodiment, the support member 82 includes a flexible substrate material 104 that enables the support member 82 to flex and/or bend between the first leg 70 and the second leg 72, and to enable the support member 82 to stretch and flex in response to the movement and/or placement of a portion of the patient's leg on the support member 82. More specifically, as the patient places one or more legs onto the support member 82, a portion of the support member 82 flexes and/or sags between the first and second legs 70 and 72. In one embodiment, a hydrophobic coating is applied across at least a portion of the flexible substrate material 104 to facilitate preventing fluids from being absorbed by the substrate material 104.

Moreover, the substrate material 104 enables each leg 22 to be independently positionable relative to the support member 82 such that the patient may adjust a position of the first leg 70 and/or the second leg 72 with the support member 82 extending across the second gap 78. The substrate material 104 may include, but is not limited to only including, a nylon woven mesh, a rubber, a plastic, and/or any suitable material that enables the leg support assembly 12 to function as described herein.

The support member 82 also has a length 106 measured between the upper end 90 and the lower end 92 along longitudinal axis 42. In the illustrated embodiment, the support member length 106 is approximately equal to the leg length 58 such that the support member 82 extends across each leg 22 from the leg first end 50 to the leg second end 52. Moreover, the support member 82 is coupled to each leg 22 such that the lower end 92 is adjacent to the leg second end 52 and the upper end 90 is adjacent to the leg first end 50. Alternatively, the support member length 106 may be shorter than, and/or longer than the leg length 58.

In the illustrated embodiment, each fastening assembly 84 extends outwardly from the support member 82 to facilitated coupling the support member 82 to the support frame 14 and/or the legs 22. In one embodiment, each fastening assembly 84 includes hook and loop fasteners such as, for example, VELCRO®. Alternatively, the fastening assemblies 84 may include button snaps and/or any suitable fastening device that enables the leg support assembly 12 to function as described herein. In the illustrated embodiment, the leg support assembly 12 includes a pair 108 of upper fastening assemblies 110 that extend outwardly from the upper end 90. Each upper fastening assembly 110 is spaced a distance 112 inboard from the first end 94 and the second end 96, respectively. Moreover, adjacent upper fastening assemblies 110 are spaced a distance 114 apart along the transverse axis 48. Each upper fastening assembly 110 includes a pair 116 of fastening straps 118. Each fastening strap 118 is releasably coupled to a corresponding strap 118 to couple the support member 82 to the frame 14.

In the illustrated embodiment, the leg support assembly 12 also includes one or more lower fastening assemblies 120. Each lower fastening assembly 120 includes a first fastening member 122 that extends outwardly from the first end 94, and a second fastening member 124 that extends outwardly from the second end 96. The second fastening member 124 is releasably coupled to the first fastening member 122 to facilitate coupling the support member 82 to each leg 22. More specifically, the support member 82 is coupled to each leg 22 such that the support member first end 94 is wrapped around a portion of the first leg 70 and the support member second end 96 is wrapped around a portion of the second leg 72, and such that the first fastening member 122 extends towards second fastening member 124. Moreover, the support member 82 is orientated with respect to each leg 22 such that the first fastening member 122 and the second fastening member 124 each extend across the second gap 78, and is adjacent to the support member inner surface 86. Accordingly, in the illustrated embodiment, the support member outer surface 88 prevents a patient's leg from contacting the lower fastening assembly 120. In an alternative embodiment, the first fastening member 122 is coupled to the first leg 70 and the second fastening member 124 is coupled to the second leg 72. In another embodiment, the first fastening member 122 and the second fastening member 124 may each be releasably coupled to the support member inner surface 86 and/or the support member outer surface 88.

In the illustrated embodiment, the leg support assembly 12 includes a first lower fastening assembly 126 and a second lower fastening assembly 128 that is spaced a distance 130 from the first lower fastening assembly 126 along longitudinal axis 42. In addition, the first lower fastening assembly 126 is spaced a distance 132 from the upper end 90 and the second lower fastening assembly 128 is spaced a distance 134 from the lower end 92. In one embodiment, the first distance 132 is approximately equal to the second distance 134. Alternatively, the first distance 132 may be greater than or less than the second distance 134 to facilitate coupling the leg support assembly 12 to the legs 22.

Figure 6:
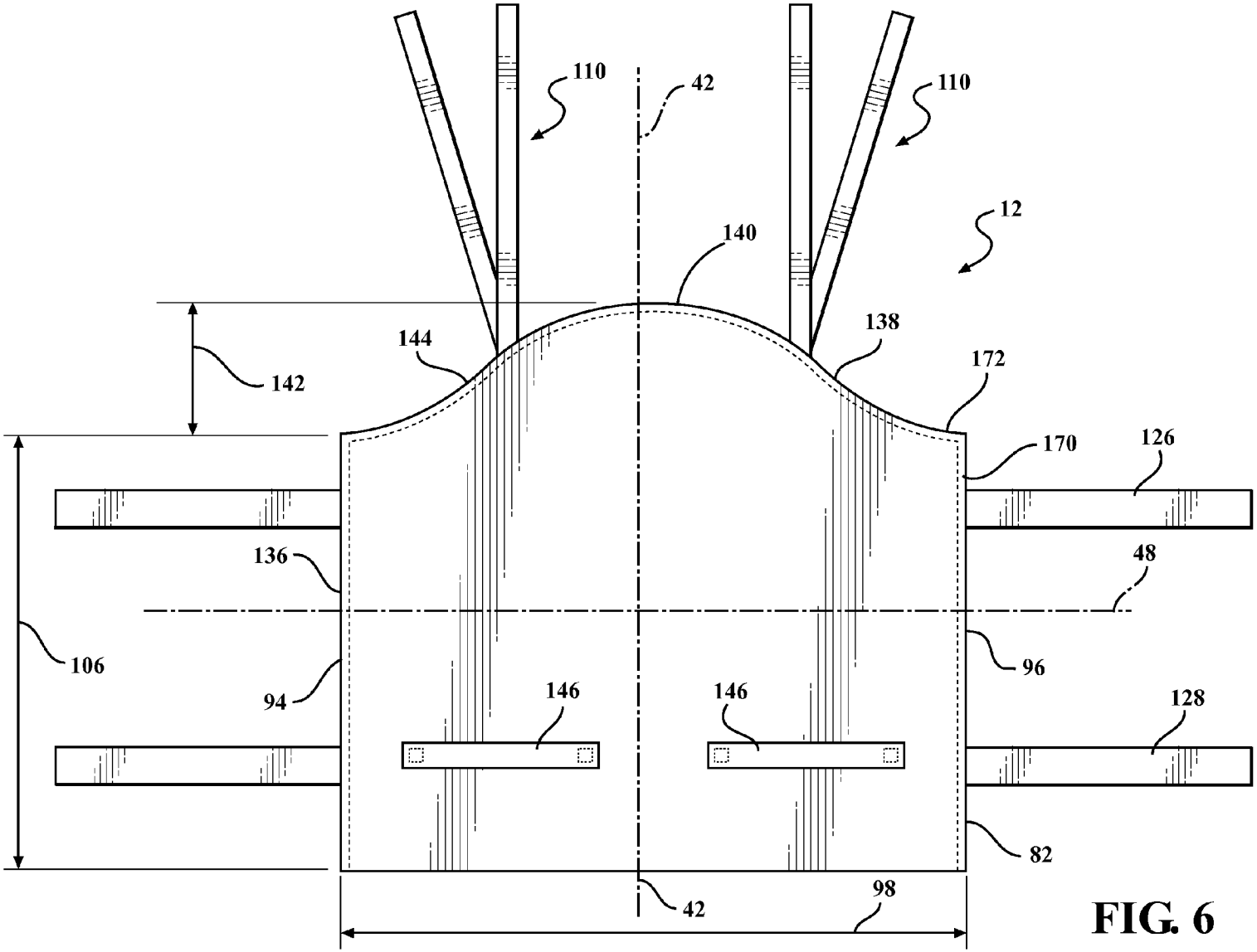
FIGS. 6 and 7 are schematic front views of the leg support assembly shown in FIG. 5.
Figure 7:
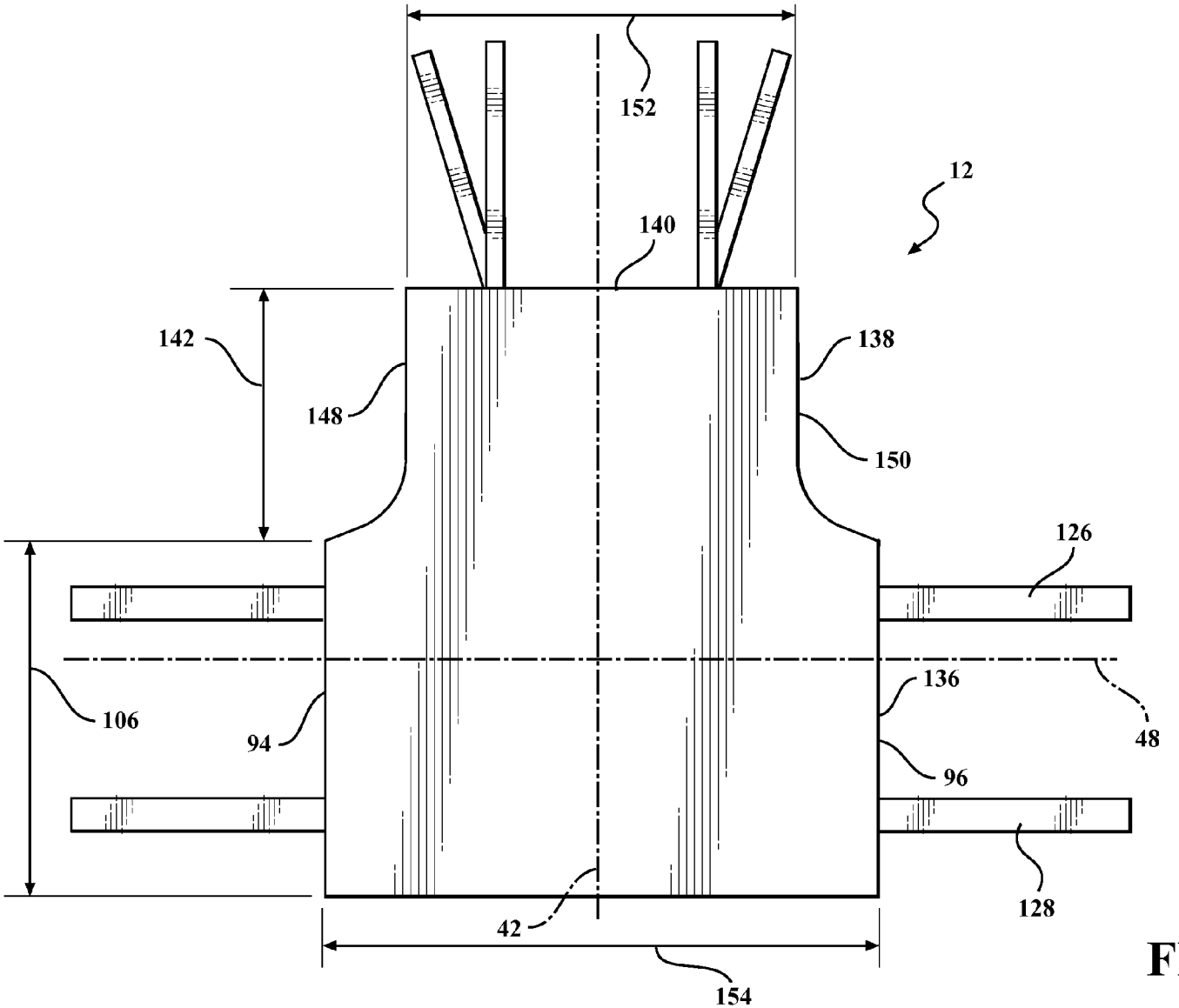

FIGS. 6 and 7 are schematic front views of the leg support assembly 12. Identical components shown in FIGS. 6 and 7 are labeled with the same reference numbers used in FIGS. 1-5. Referring to FIG. 6, in one embodiment, the support member 82 includes a base portion 136 and an upper portion 138 that extends outwardly from the base portion 136 along the longitudinal axis 42. The upper portion 138 includes an upper edge 140 that extends between the support member first end 94 and the support member second end 96 along the transverse axis 48, and extends a distance 142 outwardly from the base portion 136 along the longitudinal axis 42. In one embodiment, the upper edge 140 includes an arcuate outer edge 144. The base portion 136 extends between the first leg 70 and the second leg 72 such that the base portion 136 extends across the second gap 78. The upper portion 138 extends from the base portion 136 towards the seat assembly 18 such that the upper portion 138 extends across the first gap 62 to prevent the patient 32 from extending through the first gap 62.

In the illustrated embodiment, the leg assembly support 12 includes one or more leg restraints 146 that are releasably attached to the support member outer surface 88. Each leg restraint 146 is coupled to the support member 82 such that an opening (not shown) is defined between the leg restraint 146 and the support member 82. The opening is sized and shaped to receive at least a portion of the patient's leg therethough to facilitate supporting the patient's leg from the support member 82 to reduce a sudden movement of the leg. The leg restraints 146 may be coupled to the support member 82 with a fastening device including, but not limited to, hook and loop fasteners such as, for example, VELCRO®, button snaps and/or any suitable fastening device that enables the leg restraints 146 to function as described herein.

Referring to FIG. 7, in one embodiment, the upper portion 138 extends between a first edge 148 and a second edge 150, and includes a first width 152 measured between the first edge 148 and the second edge 150 along the transverse axis 48. The base portion 136 extends between the support member first end 94 and the support member second end 96, and includes a second width 154 measured between the first end 94 and the second end 96 along the transverse axis 48. In the illustrated embodiment, the upper portion width 152 is less than the base portion width 154. Alternatively, the upper portion width 152 may be greater than, or approximately equal to, the base portion width 154. The base portion 136 is coupled to each leg 22 and extends across the second gap 78. The upper portion 138 extends outwardly from the base portion 136 towards the support frame rear section 24 such that the upper portion 138 extends across at least a portion of the seat assembly 18. Moreover, in one embodiment, the support member 82 is coupled to the support frame 14 such that the upper portion 138 extends across the seat assembly 18 from the plate forward end 38 to the plate rear end 40, and is positioned between the seat 36 and the plate 34. In one embodiment, the upper fastening assemblies 110 extend outwardly from the upper portion 138 to the support frame rear section 24 to facilitate coupling the upper portion 138 to rear section 24. In another embodiment, the support member 82 is coupled to the seat assembly 18. More specifically, the support member 82 is coupled to the seat 36 and extends outwardly from the seat 36 towards the legs 22. In one embodiment, the seat 36 and/or the plate 34 is formed integrally with the support member 82.

Figure 8:
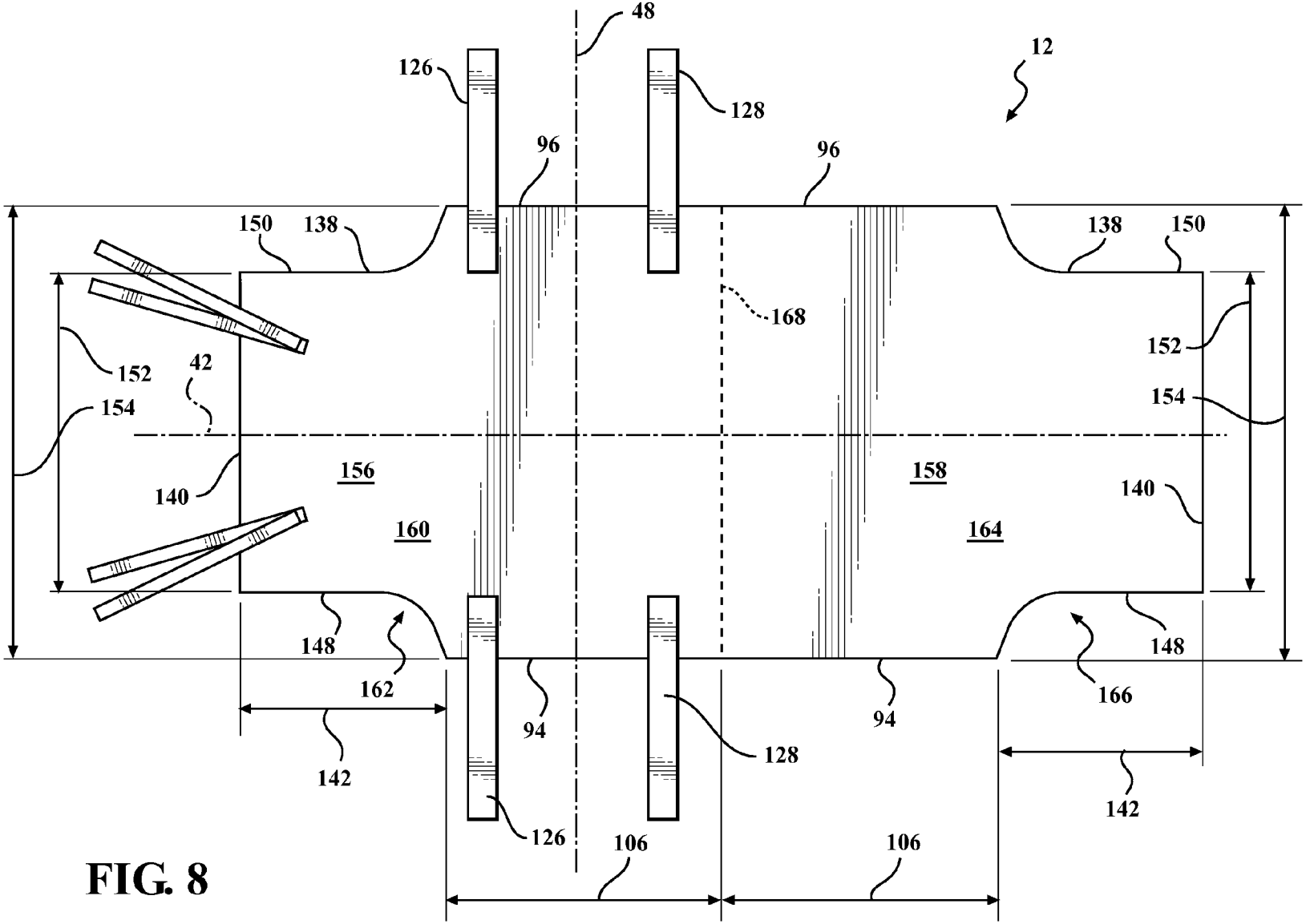
FIG. 8 is a schematic view of a partially assembled leg support assembly shown in FIG. 5.

FIG. 8 is a schematic view of a partially assembled leg support assembly 12. In the illustrated embodiment, the leg support assembly 12 includes a first sidewall 156 and a second sidewall 158 that extends outwardly from the first sidewall 156 along the longitudinal axis 42. The first sidewall 156 includes an interior surface 160 and an opposite exterior surface 162. Similarly, the second sidewall 158 includes an interior surface 164 and an exterior surface 166. One or more fold lines 168 are defined between the first sidewall 156 and the second sidewall 158, and are orientated along the transverse axis 48. The second sidewall 158 is substantially similar to the first sidewall 156 and is foldable along the fold lines 168 towards the first sidewall 156 to form the support member 82. In the illustrated embodiment, each fastening assembly 84 is coupled to the first sidewall interior surface 160. The second sidewall 158 is coupled to the first sidewall 156 such that the first sidewall interior surface 160 is adjacent to the second sidewall interior surface 164. In one embodiment, the first sidewall 156 is coupled to the second sidewall 158 with a plurality of stitches 170 (shown in FIG. 5) that extend along a perimeter 172 (shown in FIG. 5) of the support member 82. Alternatively, the first and second sidewalls 156 and 158 may include a plurality of fasteners and/or clasps that couple the first sidewall 156 to the second sidewall 158.

The above-described systems and methods overcome at least some disadvantages of known wheelchairs by providing a leg support assembly that extends between adjacent wheelchair legs to prevent a patient's legs from undesirably entering a gap defined between adjacent legs. In addition, the leg support assembly includes a flexible support member that is coupled to each leg, and extends between the adjacent legs to prevent a patient's leg from contacting an outer surface of the legs. By providing a flexible leg support assembly that extends between adjacent legs, a patient's legs are prevented from entering through the gap and injuries to the patient are facilitated to be reduced.

Exemplary embodiments of leg support assembly for use with a wheelchair and methods of assembling a wheelchair are described above in detail. The systems and methods are not limited to the specific embodiments described herein, but rather, components of systems and/or steps of the method may be utilized independently and separately from other components and/or steps described herein. For example, the systems and method may also be used in combination with other wheelchair assemblies, and are not limited to practice with only the wheelchair assembly as described herein. Rather, the exemplary embodiment can be implemented and utilized in connection with many other wheelchair assemblies.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A leg support assembly for use with a wheelchair, the wheelchair including a frame, a seat assembly coupled to the frame, and a pair of legs extending outwardly from the frame, the pair of legs including a first leg and a second leg spaced a distance from the first leg such that a gap is defined therebetween, the leg support assembly comprising:

a support member comprising a first end and a second end, the first end removably coupled to the first leg, the second end removably coupled to the second leg, the support member comprising a flexible substrate material extending across the leg gap to prevent a patient seated in the wheelchair from entering the gap, the flexible substrate material including a first sidewall, a second sidewall that is coupled to the first sidewall with a thread that is stitched through the first and the second sidewalls along a perimeter of the support member, and a hydrophobic coating that is applied across at least a portion of the first and the second sidewalls; and at least one fastening assembly coupled to the support member to facilitate coupling the support member to the wheelchair.

2. A leg support assembly in accordance with claim 1, wherein each of the first and second legs include a first end, an opposite second end, and a length measured between the first end and the second end, the support member comprising an upper end, an opposite lower end, and a length measured between the upper end and the lower end, the support member coupled to the first and second support legs such that the support member extends across each of the leg lengths.

3. A leg support assembly in accordance with claim 2, wherein the at least one fastening assembly comprises an upper fastening assembly extending outwardly from the upper end, the upper fastening assembly adapted to be coupled to the wheelchair frame.

4. A leg support assembly in accordance with claim 3, wherein the upper fastening assembly comprises a pair of fastening straps, the fastening straps being removably coupled to each other to couple the support member to the frame.

5. A leg support assembly in accordance with claim 1, wherein the at least one fastening assembly comprises at least one lower fastening assembly for coupling the support member to each of the pair of support legs, the at least one lower fastening assembly comprising:

a first fastening member extending outwardly from the first end; and a second fastening member extending outwardly from the second end, the first fastening member being removably coupled to the second fastening member to facilitate coupling the support member to each of the pair of support legs.

6. A leg support assembly in accordance with claim 5, wherein the at least one fastening assembly includes a first lower fastening assembly and a second lower fastening assembly spaced a distance from the first lower fastening assembly.

7. A leg support assembly in accordance with claim 1, wherein the leg gap has a width measured between the first leg and the second leg, the support member having a second width measured between the first end and the second end that is larger than the gap width.

8. A leg support assembly in accordance with claim 1, wherein the support member comprises a base portion and an upper portion, the base portion extends across each leg of the pair of legs, the upper portion extends outwardly from the base portion towards the seat assembly such that the upper portion extends across at least a portion of the seat assembly.

9. A leg support assembly in accordance with claim 1, further comprising at least one leg restraint coupled to an outer surface of the support member, the at least one leg restraint defining an opening that is sized the receive at least a portion of a patient's leg therethrough.

10. A wheelchair assembly comprising:

a support frame;

a seat assembly coupled to the support frame;

a pair of legs coupled to the support frame and extending outwardly from the seat assembly, the pair of legs comprising a first leg and a second leg spaced a distance from the first leg such that a gap is defined therebetween; and a leg support assembly coupled to the pair of legs, the leg support assembly comprising:

a support member comprising a first end and a second end, the first end removably coupled to the first leg, the second end removably coupled to the second leg, the support member comprising a flexible substrate material extending across the leg gap to prevent a patient seated in the wheelchair from entering the gap, the flexible substrate material including a first sidewall, a second sidewall that is coupled to the first sidewall with a thread that is stitched through the first and the second sidewalls along a perimeter of the support member, and a hydrophobic coating that is applied across at least a portion of the first and the second sidewalls; and at least one fastening assembly coupled to the support member to facilitate coupling the support member to the pair of support legs.

11. A wheelchair assembly in accordance with claim 10, wherein each of the first and second legs include a first end, an opposite second end, and a length measured between the first end and the second end, the support member comprising an upper end, an opposite lower end, and a length measured between the upper end and the lower end, the support member coupled to the first and second support legs such that the support member extends across each of the leg lengths.

12. A wheelchair assembly in accordance with claim 11, wherein the at least one fastening assembly comprises an upper fastening assembly extending outwardly from the upper end, the upper fastening assembly adapted to be coupled to the wheelchair frame.

13. A wheelchair assembly in accordance with claim 12, wherein the upper fastening assembly comprises a pair of fastening straps, the fastening straps being removably coupled to each other to couple the support member to the frame.

14. A wheelchair assembly in accordance with claim 10, wherein the at least one fastening assembly comprises at least one lower fastening assembly for coupling the support member to each of the pair of support legs, the at least one lower fastening assembly comprising:

a first fastening member extending outwardly from the first end; and a second fastening member extending outwardly from the second end, the first fastening member being removably coupled to the second fastening member to facilitate coupling the support member to each of the pair of support legs.

15. A wheelchair assembly in accordance with claim 10, wherein the support member comprises a base portion and an upper portion, the base portion extends across each leg of the pair of legs, the upper portion extends outwardly from the base portion towards the seat assembly such that the upper portion extends across at least a portion of the seat assembly.

16. A wheelchair assembly in accordance with claim 10, further comprising at least one leg restraint coupled to an outer surface of the support member, the at least one leg restraint defining an opening that is sized the receive at least a portion of a patient's leg therethrough.

17. A method of assembling a leg support assembly for use with a wheelchair, the method comprising:

providing a flexible substrate material;

forming a first sidewall and a second sidewall from the flexible substrate material, the first sidewall and the second sidewall each including an inner surface, an outer surface, a first end, and an opposite second end, the inner surface and the outer surface extending between the first end and the second end;

defining a fold line between the first sidewall and the second sidewall;

coupling a plurality of fastening members to the first sidewall inner surface, each fastening member of the plurality of fastening members extending outwardly from the first sidewall;

folding the first sidewall towards the second sidewall along the fold line;

coupling the second sidewall to the first sidewall such the first sidewall inner surface is adjacent to the second sidewall inner surface;

stitching a thread through each of the first and second sidewalls along a perimeter of the first and second sidewalls to form the leg support assembly; and applying a hydrophobic coating across at least a portion of each first and second sidewall outer surfaces.

18. A method in accordance with claim 17, wherein the wheelchair includes a frame, a seat assembly coupled to the frame, and a pair of legs extending outwardly from the frame leg support assembly includes a base portion and an upper portion, the base portion extends across each of the pair of legs, the upper portion extends outwardly from the base portion towards the seat assembly such that the upper portion extends across at least a portion of the seat assembly.

19. A method in accordance with claim 17, further comprising the step coupling a first fastening member extending outwardly from the first end; and coupling a second fastening member extending outwardly from the second end, the first fastening member being removable coupled to the second fastening member to facilitate coupling the support member to each of the pair of support legs.

20. A method in accordance with claim 17, further comprising the steps of coupling at least one leg restraint to the first sidewall outer surface.

* * * * *